US005184441A

United States Patent [19]

Balfanz, Jr.

[11] Patent Number: 5,184,441

[45] Date of Patent: Feb. 9, 1993

[54] TOP CAP WITH SNAP-IN ACCENT STRIP FOR WALL PANELS

[75] Inventor: Glenn F. Balfanz, Jr., Oswego, Ill.

[73] Assignee: Allsteel Inc., Aurora, Ill.

[21] Appl. No.: 699,886

[22] Filed: May 14, 1991

[51] Int. Cl.[5] ..... E04C 1/39

[52] U.S. Cl. ..... 52/241; 52/238.1; 52/239; 52/821; 52/823

[58] Field of Search ..... 52/823, 824, 716, 717.1, 52/718.1, 241, 238.1, 239, 284, 465, 239; 160/135, 351

[56] References Cited

U.S. PATENT DOCUMENTS 3,871,153 3/1975 Birum, Jr. ..... 52/624
4,130,972 12/1978 Varlonga ..... 52/241
4,838,004 6/1989 Adell ..... 52/718.1
5,025,603 6/1991 Johnson ..... 52/239
5,086,606 2/1992 Finses ..... 52/239

*Primary Examiner*—Richard E. Chilcot, Jr.
*Assistant Examiner*—Matthew E. Leno
*Attorney, Agent, or Firm*—Lee, Mann, Smith, McWilliams, Sweeney & Ohlson

[57] ABSTRACT

A top cap for attachment to and concealment of a wire channel along the tops of a wall panels. The top cap has a groove structure that inwardly engages the wire channel and outwardly forms a receiving groove snap-engageable to a detachable trim strip. The trim strip being field or factory installed and may be removed for replacement by other trim strips for achieving different aesthetic arrangements.

5 Claims, 2 Drawing Sheets

TOP CAP WITH SNAP-IN ACCENT STRIP FOR WALL PANELS

BACKGROUND OF THE INVENTION

The invention is generally related to providing a wall panel top cap that has a separable accent strip. The invention is more specifically related to a top cap for wall panels of a space divider system that allows the factory or field installation of a snap-in accent trim strip therealong. Even more particularly, the invention is directed toward a top cap and accent strip that are nestingly cooperative with engageable edge portions of a channel arranged along the tops of wall panels of a space divider system.

In typical space divider systems wall panels are attached to framing members and usually a decorative top cap or strip is provided to create a finished decorative appearance along the tops of the panels. This is common in office space divider systems that create individual employee work stations. Typically, the top cap would have an exterior shape or surface treatment that is aesthetically pleasing. Also, color coordinated attachment strips, surface textures, embossments, relief patterns, and the like, may be provided to achieve a decorative appearance for the wall panel system. The wall panels are also usually available in a variety of fabric textures and colorings to meet interior design requirements.

Wall panels in space divider systems may also be constructed with acoustical laminates such as fiberglass, honeycomb cardboard, mineral fiber, and the like, that may be laminated to gypsum board or have intermediate metal layers. Typically, the wall panels are mounted to vertical and horizontal framing members that serve to rigidly support the panels. The framing members are attached to the floor and/or walls of an existing room to divide it for segregating work stations as to need and function. By necessity, these work stations must be electrified to permit the operation of office equipment. Thus, wire channels are customarily provided as the top horizontal frame members of the wall systems for receiving therein cables, conduits, wire harnesses and the like in a concealed workmanlike arrangement. Therefore, a top cap is required to cover over the wire channel and be complementary therewith to conceal the wiring therein.

Further, it would be desirable for a top cap to be mountable on the wire channel arranged at the top of wall panel framing.

Moreover, it concomitantly would be very useful to provide a top cap with an attachably engaged accent strip that permits the purchaser of the wall system to have the option of removing the accent strip and easily replacing it with one of a different color or style to meet interior design changes and remodeling.

It is accordingly an object of the invention to provide a top cap for a wall panel system that is engageable with an upper horizontal frame member, such as a wire channel or equivalent, and provides a means for detachably engaging an accent trim strip.

It is an allied goal of the invention to offer a dual purpose top cap engageable means that at one side is mountingly engageable to a complementarily shaped side wall portion of a wire channel, or the like, and at the opposite side is engageable with a detachable accent strip.

It is also a target of the invention to make available a snap-in accent strip that is capable of being installed at the factory or field installed by the field installer.

It is an adjunct goal of the invention to form an elongate outwardly open groove-like means at both sides of a top cap, each of which serves a dual purpose of providing means to attach to the top cap to a wire channel of a panel frame and snap-engageable means for snap-engaging an accent strip.

It is a related object of the invention to provide a top cap that may be made of extruded or roll-formed metal, that is capable of being painted, electroplated, embossed, or alternatively being wrapped in a decorative wood veneer, while concurrently being formed to have an accent strip-receivable elongate groove and frame-engageable means for concealing a top channel member of a wall panel framing system.

SUMMARY OF THE INVENTION

The invention may be briefly described as providing a downwardly open elongate cap having side walls terminating in channel engageable in-turned and rebated groove-structures. The groove-structures having generally opposingly directed means for nested attachment to complementarily formed side walls of a wire channel, or the like. An outwardly directed leg of the groove structures having snap-over means for snap-engagement with a uniquely formed accent trim strip.

The accent strip has a wide and narrow portion wherein the wide portion provides an outwardly-apparent decorative surface and the narrow portion includes means that are snap-engageable with said snap-over means of the top cap. Each groove structure of the top cap serves a dual function of nestably engaging an accent strip at an outwardly open groove and at an inwardly directed part of the groove structure being capable of nestable engagement to a generally complementarily formed side wall of a wall frame member, such as a wire channel, or the like.

The accent strip preferably being formed from a material that can resiliently snap-engage and disengage with the top cap to allow for easy installation at the factory or in the field; further allowing detachment for replacement with different shaped or colored accent strips.

DETAILED DESCRIPTION OF THE INVENTION

Figure 1:
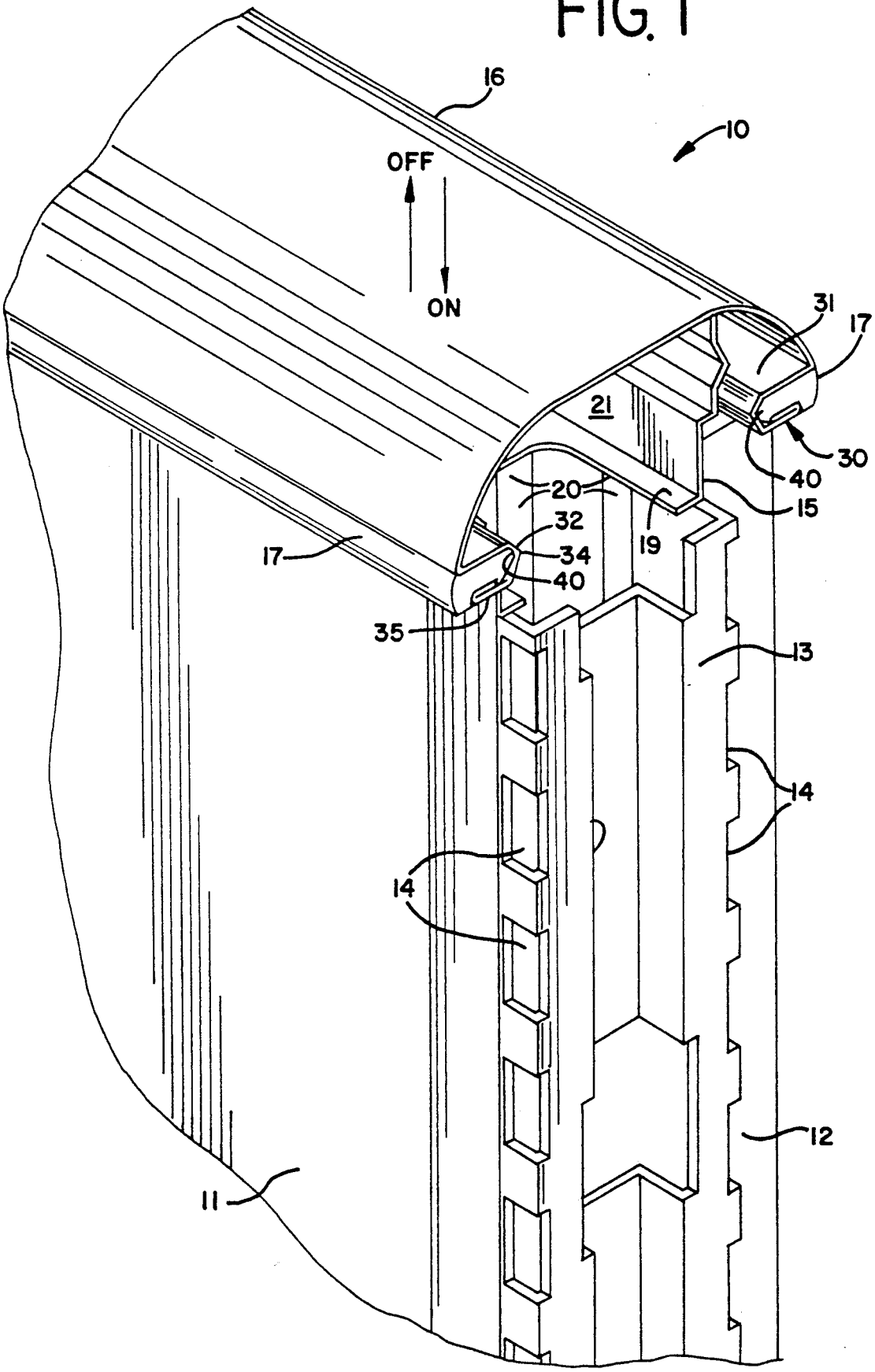
FIG. 1 is a perspective view looking downwardly at a vertical edge of a cut-away portion of a wall system having wall panels at opposite sides, a vertical framing member, and a top horizontal wire channel covered by the inventive top cap and accent strip nestingly engaged therewith.
Figure 2:
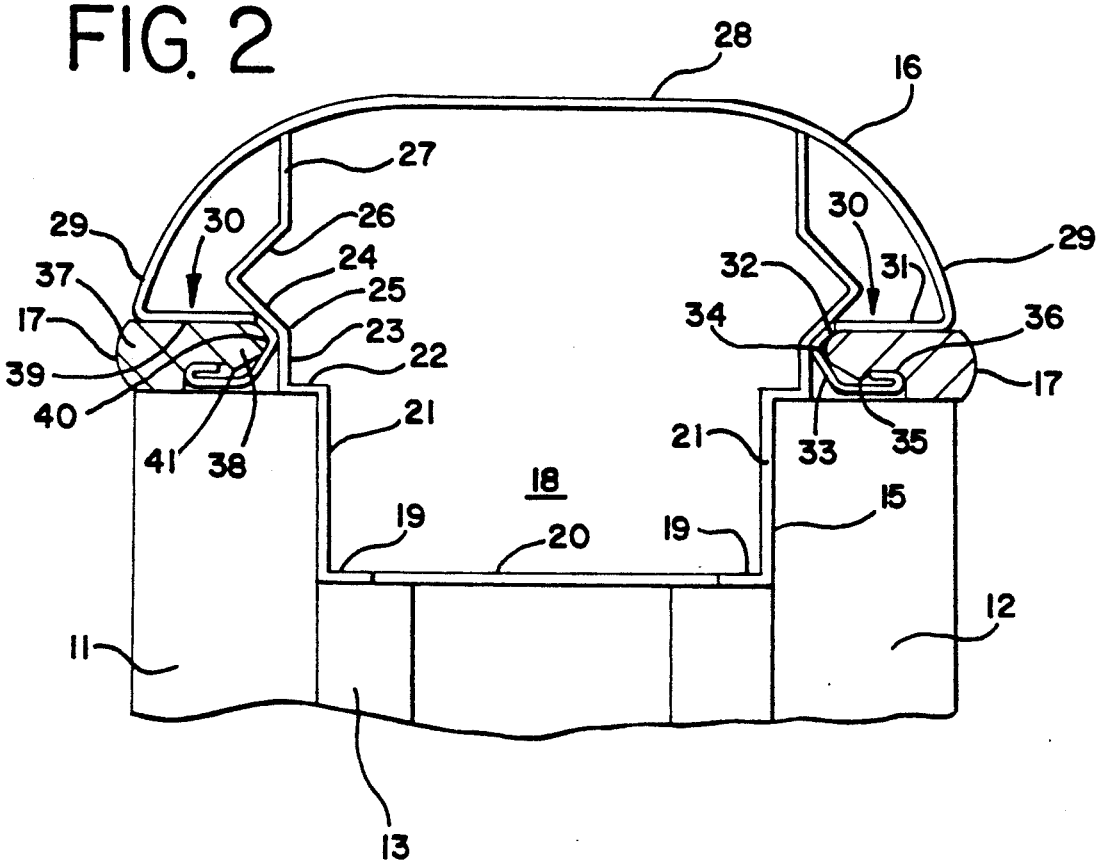
FIG. 2 is a vertical sectional view of the wall system as shown in FIG. 1; and, FIG. 3 is a vertical section as in FIG. 2 showing an alternate embodiment for the top cap.
Figure 3:
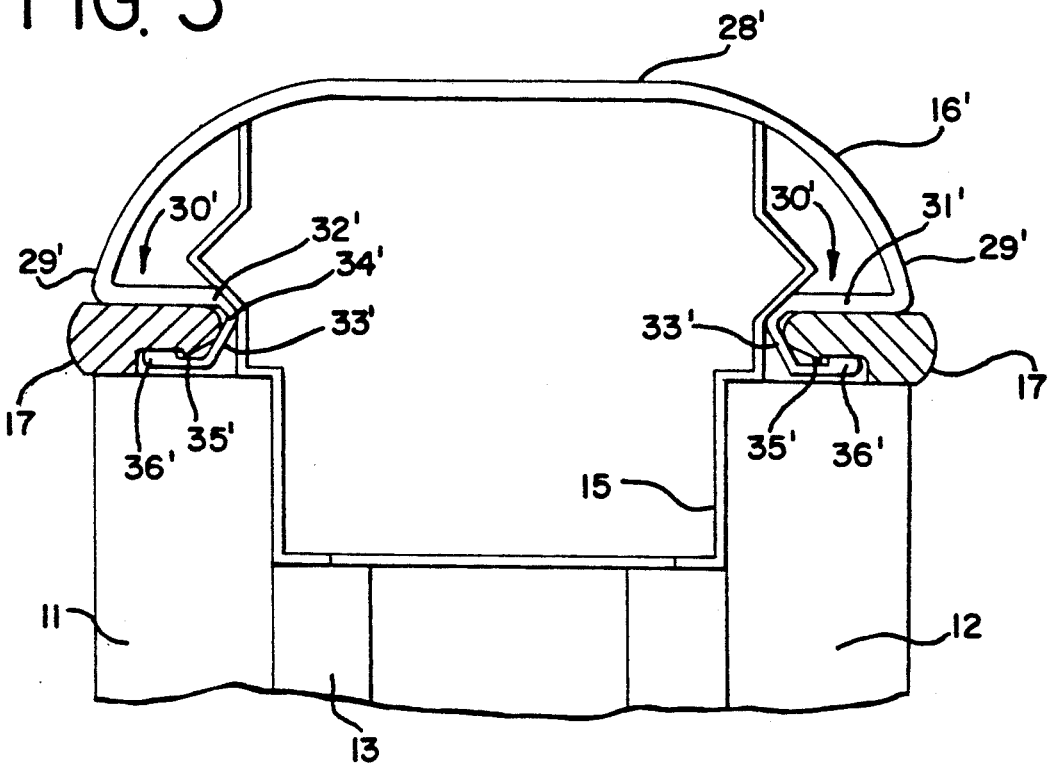

In FIGS. 1-3, like reference numerals refer to the same elements throughout.

With attention first directed to FIG. 1, a perspective broken-away view generally at a joint of a wall assembly 10 is shown. The wall assembly 10 includes two wall panels 11, 12 at opposite sides of a vertical support frame member 13 having engageable slots 14 for the attachment of the wall panels 11, 12 in a generally known manner. The wall assembly 10 is of the kind used in space divider systems, such as for arranging work stations in offices, classrooms, libraries, and the like.

At the top of the wall assembly 10 a wire channel 15 is arranged and supported by a horizontal frame member, which are supported by vertical frame members at either end, such as at 13. The wire channel 15 accommodates cables, wires, wire harnesses, cords and the like for providing data and communication cabling, and the like, at a work station. In accordance with the invention, a top cap 16 is detachably engaged to the wire channel 15 for concealing the wires, cables, etc., therein. Further, the top cap 16 is nestably snap-engaged by accent strips 17, at opposite sides thereof as will be explained in greater detail below.

With reference also to FIG. 2, it will be seen that the accent strips 17 engage portions of the trim cap 16 that also serve the dual function of providing the attachment means for detachably mounting it to the wire channel 15.

Starting with the wire channel 15, it will be noted that it provides a lower trough-like portion 18 for the receipt therein of wires, cables and the like, which has a bottom wall 19 that includes end access cut-outs at 20, shown in FIG. 1, to provide clearance for panel-to-panel connectors (not shown) in a usual manner. The bottom wall 19 meets vertical side walls 21 which are spaced apart but fit between the wall panels 11, 12. The side walls 21 are out-turned at 22 to rest atop the wall panels 11, 12 and prevent disengagement of the wall panels. The out-turned portions 22 are joined to up-turned legs 23 that meet upwardly and outwardly angled walls 24 at a bend 25. The portions 22, 24 and 25 form the engageable means of the wire channel 15 to be detachably engaged by the top cap 16. The angled portions 24 terminate at re-bent portions 26 which are angled inwardly of the wire channel and join vertical flanges 27. In the exemplar, there is no joinder across the wire channel 15 between the flanges 27, so that wires and the like may be placed directly therein from above prior to the attachment of the top cap 16. However, enclosed wire channels, or other horizontal frame members, for example, having tubular configurations, are also encompassed by the present invention. For use with enclosed channels, or other horizontal frame members, the top cap 16 would be sized to accommodate the particular shape. The top cap attachment is along the channel side wall and not dependent upon whether the top of the channel is covered or open. The top cap 16 resiliently snaps over the wire channel 15 from the top thereof and is removable by the reverse movement indicated by the arrows in FIG. 1.

The top cap 16 in the preferred embodiment has a generally dome-like shell configuration having a top wall 28 that transitions to downwardly curved side walls 29 which terminate in in-turned and rebated engageable groove structures 30 formed to snap-engage at either side of the wire channel 15. The groove structures 30 are formed to contact the wire channel 15 generally at the bend 25 underneath the upwardly angled wall 24 and to rest along the tops of the panels 11, 12 below. The groove structures 30 comprise in-turned generally horizontal flanges 31 which meet inwardly and downwardly angled legs 32 providing the means for contact below the outwardly angled walls 24. The legs 32 join outwardly bent legs 33 at bends 34 formed to be positioned along the bends 25 of the wire channel 15 for a nested contact therebehind. The horizontal spacing between the bends 34 being sufficient to straddle the up-turned legs 23 so that the bent legs 33 of the top cap 16 may smoothly and resiliently slide down re-bent portions 26 of the wire channel 15 in order to snap the bend 34 past the portion 26 with the legs 32 moving down and underneath the angled walls 24. The groove structure 30 rebates outwardly wherein the bent legs 33 meet horizontal legs 35, which include snap-engageable means in the form of in-turned hooks 36. The in-turned flanges 31 and the rebated legs 35 are generally parallel and horizontal with the vertical spacing therebetween being satisfactory for the legs 35 to rest on the top edges of the panels 11, 12 and with sufficient clearance for the top cap 16 to snap over the wire channel 15. The spacing between the flanges 31 and the legs 35 of the groove structures 30 receive the accent strips 17 as illustrated.

The accent strips 17 have wide portions 37, which provide the exterior decorative exposed portions, and inward narrow portions 38 that are coplanar with the wide portions 37 along top surfaces 39 of the strips 17. The narrow portions 38 have snap-engageable means for attachment to the in-turned hooks 36. The snap-engageable means each comprise an inward rounded terminus 40 of the narrow portion 38 and a downwardly directed barbed tip 41 which is spaced from the wide portion 37 to offer the snap-over accommodation of the in-turned hook 36 therebetween, as shown in FIG. 2. The thickness of the wide portion 37 being sufficient to extend between the horizontal flange 31 and the tops of the panels 11, 12 in order to fill that space when viewed from the outside of the wall assembly 10. The narrow portion 38 having a thickness sized to fit between the horizontal flange 31 and the in-turned hook 36.

In the preferred embodiment, each accent strip 17 is made of extruded PVC. The wall panels 11, 12 in the illustrated embodiment are arbitrarily chosen to be $\frac{5}{8}$ inch thick but, of course, may be provided in the wide variety of dimensions used in wall panel systems. Thus, the length of the accent strip 17 would be slightly over $\frac{1}{2}$ inch in order to extend from the bend point 34 of the top cap 16 to be exposed outwardly of the panel and provide a visible decorative accent line across the top of each panel adjacent the top cap 16. The outward exposed part of the wide portion 37 may be colored, shaped, embossed, and the like as desired. In the preferred embodiment the accent strips 17 are uniformly colored extrusions. Many other extruded plastics would be equivalent substitutes for PVC, as would be understood by those skilled in the art.

It will also be appreciated that an accent strip 17 may be inserted within the groove structure 30 before or after the top cap 16 has been attached to the wire channel 15. The insertion of the accent strip 17 is accomplished by aligning the rounded terminus 40 between the in-turned hook 36 and horizontal flange 31 and by applying a slight inward force the barbed tip 41 snaps over the in-turned hook 36. With more rigid plastics, it is possible to slide the accent strip 17 from the end of the top cap 16, which might require the application of a light oil lubricant, or the like, to the interior of the groove structure 30. The wide portions 37 preferably will extend outwardly past the panels 11, 12 in order that they may be gripped by pliers, or the like, should it be required to remove the accent strips 17 when remodeling, changing color schemes and the like. Therefore, the removal can be accomplished without detaching the top cap 16 from the wire channel 15, which otherwise might be tedious when there are many wall panel sections in a system.

Alternate embodiments for the accent strip 17 would include the use of differently shaped inward ends, for example having a pointed end instead of a rounded terminus 40, or differently shaped snap-over projections equivalent to the barbed tip 41.

In FIG. 2, the top cap 16 of that embodiment is made of roll-formed steel. In FIG. 3, an alternate embodiment is shown wherein a top cap 16' is made of extruded aluminum. As a result, an in-turned hook 36, as in top cap 16, can not be formed. Instead a portion 36' is extruded in the shape of a wide node-like end of a lower horizontal leg 35' which corresponds to the leg 35 of the top cap 16. Otherwise the configuration in FIG. 3 is identical to that of FIG. 2 with like reference numerals given a prime symbol. The use of extruded aluminum or roll-formed steel would be a matter of choice to the architect or room designer, usually depending upon required exterior surface treatments for the top cap 16, which include painting, plating, covering, or embossing. The extruded aluminum alternate is well suited for receiving a wood veneer covering the top wall 28' and side walls 29'.

The present invention provides a novel structure for removably inserting an accent strip 17 within a groove structure 30 of a top cap 16 having inward opposing portions for a nested detachable engagement under angled side wall portions of a wire channel or the like. It is considered that the present invention and appended claims therefor have a range of equivalents broader than the embodiments disclosed.

What is claimed is:

1. A top cap having a dome-like wall, opposingly directed engageable structures at opposite sides of said dome-like wall having an inwardly turned horizontal flange and an outwardly turned horizontal leg joined a leg having a bend therebetween for placement along side walls of a wire channel said legs and flanges forming a pair of oppositely directed groove means for receiving an extruded trim strip, said groove means having means for snap-engaging an extruded, and, extruded trim strips snap-engaged at both of said oppositely directed groove means for substantially the full length thereof and including snap-over barb means at one portion, and another portion being outwardly exposed and capable of providing a decorative appearance.

2. A detachable top cap assembly for concealing a channel means located along the top of a wall system, the top cap assembly comprising:

an elongate shell-like cap having inwardly turned horizontal flanges spaced from outwardly turned horizontal legs forming outwardly open grooves therebetween, said flanges and said legs being joined by bent leg portions integral therewith forming opposing means for detachable engagement, said outwardly turned legs including snap-over engageable means;

a channel means having a bottom wall and side wall means, the side wall means being detachably engaged along said opposing means for detachable engagement of said top cap, and being arranged within said shell-like cap for concealment, said side wall means including an outwardly angled wall portion and an inwardly angled wall portion; and, accent strip means removably snap-engaged at said grooves and extending outwardly therefrom.

3. The detachable top cap assembly as claimed in claim 2 wherein said channel means is an open top wire channel.

4. The detachable top cap assembly as claimed in claim 2 wherein said accent strip means comprises an extruded plastic material.

5. A detachable top cap assembly for concealing a channel means located along the top of a wall system, the top cap assembly comprising:

an elongate shell-like cap having inwardly turned flanges spaced from outwardly turned legs forming groove means therebetween and joined by bent leg portions integral therewith forming opposing means for detachable engagement at opposite sides of a channel means, said outwardly turned legs including snap-over engageable means;

a channel means having side wall means detachably snap-engaged along said opposing engagement means of said top cap and being arranged within said shell-like cap for concealment wherein said opposing engagement means are nested underneath and against the side wall means of the channel means; and, accent strip means removably snap-engaged at said groove means and extending outwardly therefrom.

* * * * *